United States Patent [19]

Hickey

[11] 4,403,789

[45] Sep. 13, 1983

[54] SKI TO BOOT ATTACHMENT MECHANISM

[76] Inventor: Robert J. Hickey, 2575 Blakely Rd., South Wales, N.Y. 14139

[21] Appl. No.: 329,320

[22] Filed: Dec. 10, 1981

Related U.S. Application Data

[63] Continuation-in-part of Ser. No. 161,851, Jun. 23, 1980, abandoned.

[51] Int. Cl.[3] ..... A63C 9/08

[52] U.S. Cl. ..... 280/614; 280/636

[58] Field of Search ..... 280/611, 613, 614, 615, 280/624, 627, 635, 636

[56] References Cited

U.S. PATENT DOCUMENTS

| | | | |
|---|---|---|---|
| 3,905,613 | 9/1975 | Romeo | 280/613 |
| 4,113,275 | 9/1978 | Sherwin | 280/615 |

FOREIGN PATENT DOCUMENTS

| | | | |
|---|---|---|---|
| 681915 | 5/1930 | France | 280/615 |
| 322456 | 11/1934 | Italy | 280/615 |
| 173096 | 12/1932 | Switzerland | 280/615 |

*Primary Examiner*—Joseph F. Peters, Jr.

*Assistant Examiner*—Timothy Roesch

*Attorney, Agent, or Firm*—William P. Hickey

[57] ABSTRACT

A boot to ski attachment mechanism which provides three degrees of attachment. When the heel is against the ski a threaded detent provides a greatly adjustable retention against vertical separation with full restraint against lateral separation. When the heel is raised out of the detent to an intermediate elevation, only lateral restraint is provided. When the heel is above the intermediate elevation, the heel is free of lateral restraint to allow twisting as during a fall. These three degrees of attachment are provided by upstanding legs on opposite sides of the heel, along with detent mechanism having parts on the upstanding legs and heel. The detent action between the upstanding legs and heel is made infinitely adjustable by a threaded rod and nut arrangement with said nut being carried by either the heel structure or upstanding leg structure while the transverse pin is carried by the other of the heel or upstanding leg structures. Relative rotation of the pin and nut varies the force necessary required for vertical separation between the heel and upstanding legs.

12 Claims, 10 Drawing Figures

SKI TO BOOT ATTACHMENT MECHANISM

The present application is a continuation in part of my allowed copending application Ser. No. 161,851 filed June 23, 1980.

TECHNICAL FIELD

The present invention relates to a system for attaching a ski boot to a ski in such manner that good control of the skis will be had during down hill runs without impeding natural foot and leg movement during cross country skiing.

BACKGROUND OF THE INVENTION

During down hill skiing, the skis for the most part are kept beneath the body with the feet flat against the skis. During down hill skiing there must be a minimum of relative movement between the ski boot and the skis, so that the skis will turn laterally with the foot, and so that the skis will be held flat against the foot should the skis leave the ground. It goes without saying of course that there must be no front to rear slippage during any such movements.

In cross country skiing, the skis are alternately moved from a position behind the body to a position forward of the body similar to the movement which occurs during walking. During such movement the heel will be flat against the ski when it is forward of the body, and will lift off of the ski as it moves rearwardly of the body.

In one type of commonly used cross country ski binding, the toe of the boot is clamped to the ski in a manner permitting the boot to flex at the ball of the foot and the heel to lift off of the ski. These clamps usually, after a period of time, permit sufficient relative rotation between the boot and ski to result in poor lateral and or vertical control of the ski.

In another type of commonly used cross country ski binding, the toe of the boot is strapped to the ski; and with such an arrangement, the straps gradually flex and yield to permit a relative rotation that may result in even poorer ski control than is provided by the above described clamp arrangement.

I am aware of a prior art patent that teaches a vertical plate on the ski for abutment by the rear of the boot to prevent relative longitudinal movement between the boot and ski. I am further aware that it teaches locking means between such a rear plate and the rear of the boot; so that when the skier approaches a down hill run, he can lock the ski and boot together. This and other arrangements with which I am aware suffer from a number of deficiencies, such as trapping snow against the vertical heel plate which is then compacted as the heel comes down onto the ski during cross country skiing. This compacted snow must be removed periodically to allow proper foot movement during cross country skiing, and must also be removed before the boot can be locked onto the ski for down hill skiing. In addition, the mechanisms of which I am aware must be locked and unlocked anytime a transition is made between down hill and cross country skiing.

An object of the present invention is the provision of a new and improved system for attaching skis to ski boots in such manner that unimpaired leg movement is had during cross country skiing and good lateral control is had during down hill skiing.

A further object of the invention is the provision of a new and improved system of the above described type wherein the problem of snow accumulation between the boot and ski is greatly minimized.

A further object of the invention is the provision of a new and improved system of the above described type wherein transition between down hill and cross country skiing can be made without unlocking the ski from the boot.

A still further object of the invention is the provision of a new and improved system of the above described type wherein the boot and ski can be locked together to completely prevent compaction of snow between the boot and ski when snow conditions are such that compaction can be prevented in no other way.

Further objects and advantages of the invention will become apparent to those skilled in the art to which the invention relates from the following description of the preferred embodiments described with reference to the accompanying drawing forming a part of this specification.

DESCRIPTION OF THE PREFERRED EMBODIMENTS

Figure 1:
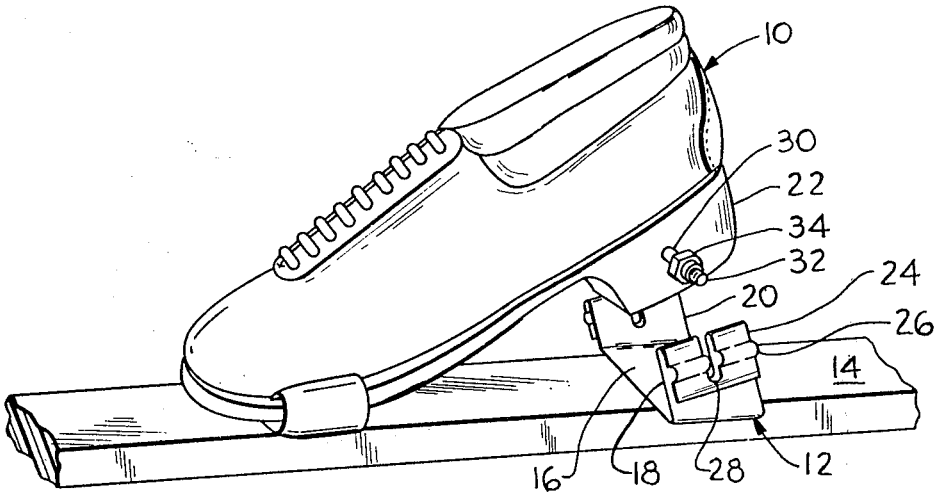
FIG. 1 is an oblique view of a ski and ski boot attachment system embodying principles of the present invention, and showing the ski boot flexed at the ball of the foot as occurs when the boot is behind the body during cross country skiing.
Figure 2:
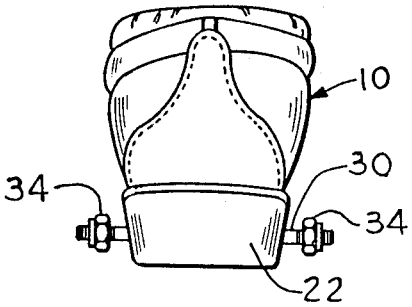
FIG. 2 is a rear view of the ski boot shown in FIG. 1.
Figure 4:
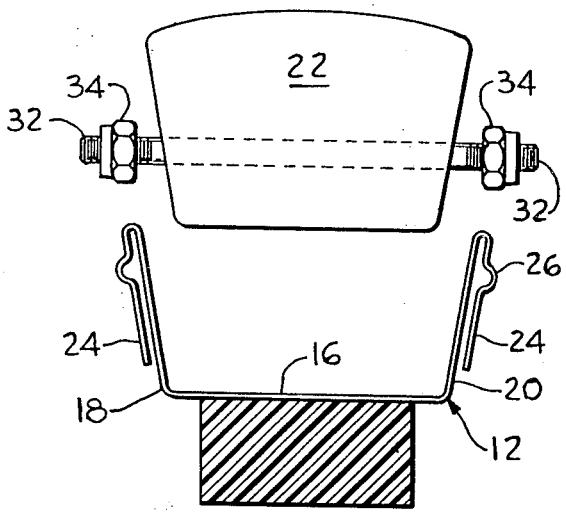
FIG. 4 is a rear view of the ski boot and heel plate in a position where the boot is about to engage the heel plate.
Figure 3:
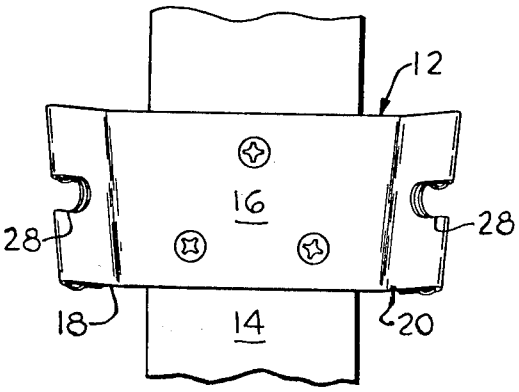
FIG. 3 is a plan view of the heel plate shown in FIG. 1.
Figure 5:
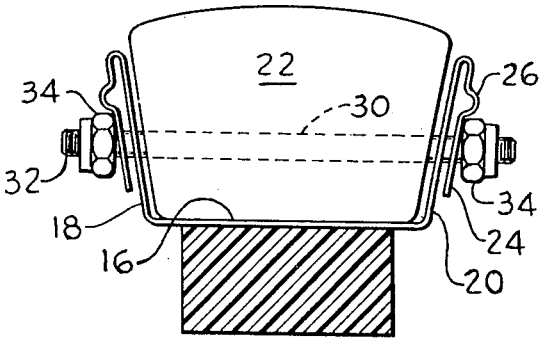
FIG. 5 is a view similar to FIG. 4 but showing the heel against the heel plate as occurs during down hill skiing.
Figure 6:
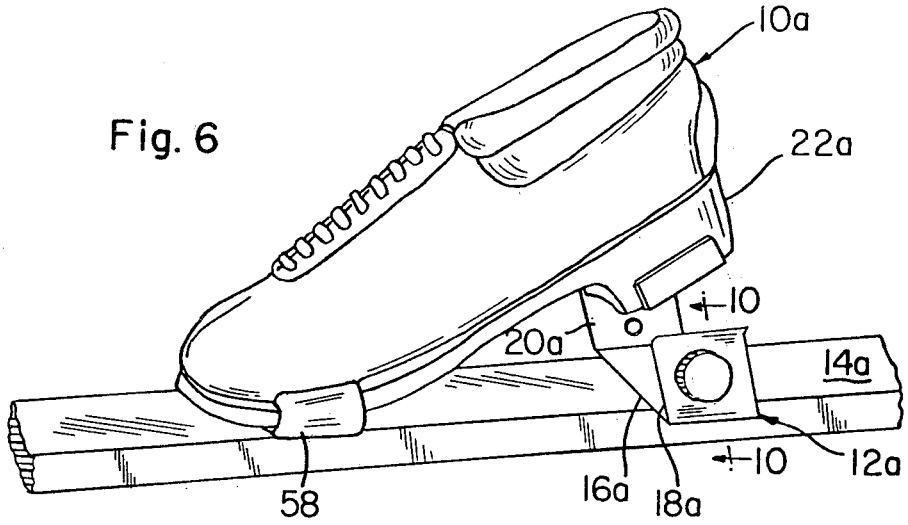
FIG. 6 is an oblique view similar to FIG. 1 but showing another embodiment of the invention.
Figure 7:
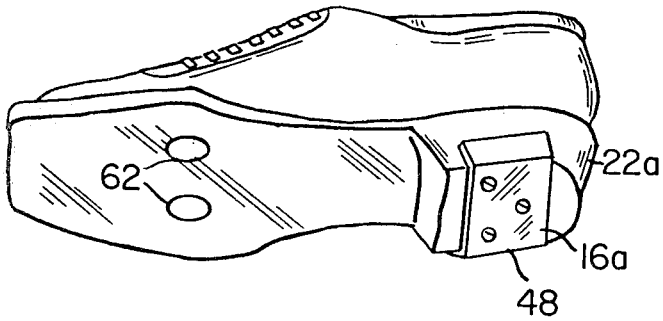
FIG. 7 is an oblique bottom view of the ski boot shown in FIG. 6.
Figure 8:
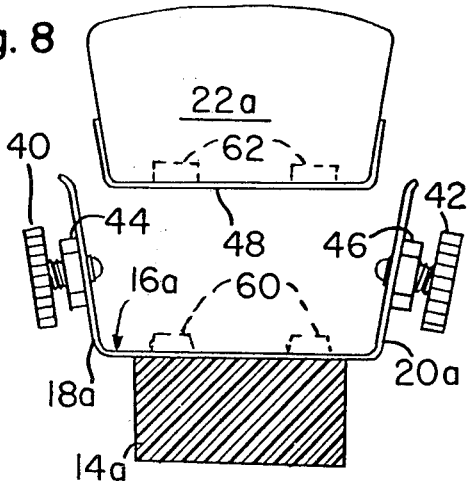
FIG. 8 is a rear view of the ski boot and heel plate of the embodiment of FIGS. 6 and 7 in a position where the boot is about to engage the heel plate.

According to principles of the present invention, mechanism is provided for restraining longitudinal movement between a ski boot and a ski by means of a transverse pin and slot mechanism, the pin of which is received in vertical open ended slots. Either the pin or slot portion of the mechanism is located in the heel of a ski boot, and the cooperating portion of the mechanism is located on structure fixed to the ski. In the preferred embodiment, the heel of the ski boot is positioned between a pair of upstanding legs which laterally confine the heel when the heel bears against the ski. In the most preferred arrangement, the upstanding legs have vertical slots opening outwardly of their upper ends and a transverse pin is fixed to the heel of the boot. Such an arrangement permits the heel to move away from the ski with ease, and automatically centers the boot laterally and longitudinally each time the heel is brought down against the ski.

While the invention may be otherwise embodied, it is herein shown and described as embodied in a cooperating ski boot 10, and a heel plate 12 that is affixed to the top surface of a ski 14. The heel plate 12, that is shown in the drawing, comprises a flat center portion 16 and opposite end upstanding leg portions 18 and 20 which are spaced apart by a distance to snuggly confine the heel 22 of the ski boot 10. The upstanding leg portions 18 and 20 shown in the drawing, are formed by doubling back the metal strip from which they are made into an inverted U-shape with the free end 24 thereof positioned outwardly of the leg. The inverted U-shaped metal provides a spring detent which will later be described. The free ends 24 are preferably bowed outwardly at their center, as at 26, to provide a detent action. The inverted U-shaped legs are each provided with a vertical slot 28 that extends from their upper ends down past their bowed center section 26. Alternatively, the detent structure can be made as a separate unit which is riveted or spot welded to the upstanding legs 18 and 20.

The heel 22 of the ski boot 10 is provided with a transverse pin 30, the opposite ends of which are threaded as at 32 to receive fiber lock nuts 34. The fiber lock nuts 34 in effect provide adjustable stops which slid over the bowed center sections 26 of the upstanding legs 18 and 20. This provides a detent means which requires a vertical pull to lift the heel away from the ski. The nuts 34 can be adjusted free and clear of the legs 18 and 20 for normal cross country skiing. With such an adjustment, the heel will move down between the legs freely, and the ski boot will be centered longitudinally and laterally with each stride as the heel slides down between the legs and the transverse pin 30 slides into the slots 28. By tightening the nuts against the spring detents, the skis can be readied for down hill skiing. When the heel is brought down upon the heel plate a vertical pull will thereafter be necessary to produce separation. This force can be adjusted so that the weight of the ski will not cause the ski to separate from the boot when the ski is off of the ground. However, even when so adjusted, the heel can be pulled out of the detent mechanism and cross country skiing can be done without appreciable difficulty. With the mechanism so adjusted, cross country skiing can be accomplished by bringing the boot heel down to where the pin engages the detent mechanism, but does not ride past the detents 26. This is no great inconvience, since a cross country skier rarely puts his full weight onto the heel. However, even with such skiing action, the boots are centered during each stride in the same manner previously described. It will be seen that the mechanism above described also permits the absence of a vertical plate at the rear of the heel which would trap snow and cause its compaction by the heel. It will also be seen that the skier is ready for down hill by merely putting his weight on his heels, to push the pin 30 past the detents 26.

The embodiment shown in FIGS. 6 through 10 corresponds generally to the embodiment shown in FIGS. 1 through 5, but differs principally in that the bolt and nut detent mechanism is in two sections instead of one. Those portions of the embodiment shown in FIGS. 6 through 10 which correspond to similar portions of the embodiment shown in FIGS. 1 through 5 are designated by a like reference number characterized further in that a suffix "a" is affixed thereto.

In the embodiment shown in FIGS. 6 through 10, there are two threaded pins 40 and 42 which project through respective nuts 44 and 46 that are affixed to respective upstanding legs **18*a* and 20*a*. The outer ends of the threaded pins 40 and 42 have large diameter heads thereon whose periphery is serrated for finger gripping and threading of the pins through the legs 18*a* and 20*a*. The inner ends of the pins are adapted to engage the respective sides of the heel 22*a* immediately above the top edges of a U-shaped plate 48 that is affixed to the bottom of the heel 22*a*. As the pins 40 and 42 are tightened against the sides of the heel 22*a*, the upstanding legs 18*a* and 20*a* are sprung outwardly to provide more and more frictional force against the heel 22*a***.

In order for the plate 48 to be moved vertically past the ends of the pins 40 and 42, the upstanding legs **18*a* and 20*a* must be sprung outwardly by an additional amount. As the pins are progressively tightened against the heel 22*a* more and more vertical lifting force of the heel 22*a*** is required to spring the legs apart and effect separation.

Figure 10:
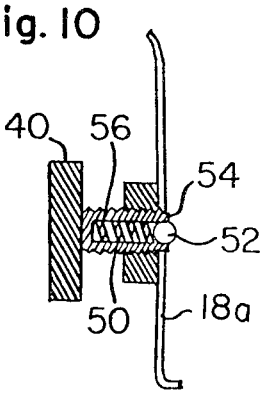
FIG. 10 is a cross sectional view taken approximately on the line 10—10 of FIG. 6.
Figure 9:
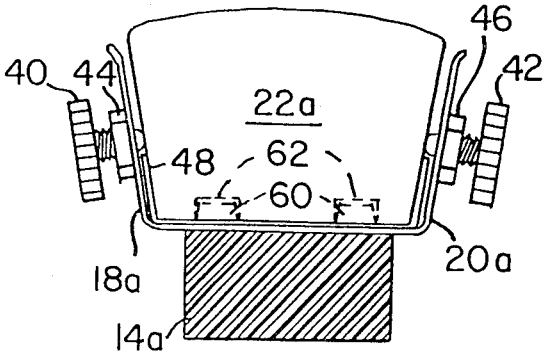
FIG. 9 is a view similar to FIG. 8 but showing the heel against the heel plate as occurs during down hill skiing.

While it is not necessary in all instances, the pins 40 and 42 may be bored out as at 50 to accomodate internal spring biased detents. As best seen in FIG. 10, a detent ball 52 is provided in the end of the bore 50 and the ends of the pin 40 are turned over into a lip 54 to retain the ball. A coil spring 56 is positioned between the ball 52 and the inner end of the bore 50. Preferably, the spring 56 is sized so that it biases the ball against the lip 54 with a force that is slightly in excess of $\frac{1}{2}$ of the weight of the rear end of the ski **14*a*. With both detent balls 52 above the top edge of the plate 48, the ski can be lifted from the ground under the action of the toe clamp 58 and ball detents 52. When detents 52 are provided, the upstanding legs are preferably stiff enough so that there is practically no deflection at this time. When it is desired that a greater force than the weight of the ski will be required for separation of the boot and ski, the pins 40 and 42 can be treated against the heel to force the detent ball inside of the bore 50. Once this has been done, the pins will be engaged by the top of plate 48 and a force greater than the weight of the ski will be required for separation. This force can be still further increased by increasing the projection of the pins 40 and 42 through their upstanding legs to increase the deflection and spring force of the upstanding legs. In the embodiment being described, the ski is provided with frustoconical projections 60 which are received in cylindrical openings 62 in the sole of the boot 10*a* inwardly of the toe clamp 58** to prevent longitudinal separation of the boot and ski.

While the invention has been described as releasably securing the heel of a ski boot to the ski, it can also be adapted to releasably secure the toe of the boot to the ski. It will be seen that construction of the present invention, when located forwardly of the ball of the foot, will locate the toe laterally and longitudinally of the ski and still permit unrestrained flexing at the ball.

While the heels of most ski boots are more narrow at the back than at the front, it is also within the contemplation of the present invention to make the sides of the heel generally parallel so as to minimize the trapping of snow beneath the heel.

While the invention has been described in considerable detail, I do not wish to be limited to the particular embodiments shown and described, and it is my intention to cover hereby all novel adaptations, modifications, and arrangements thereof which come within the practice of those skilled in the art and fall within the purview of the following claims.

I claim:

1. A system for releasably securing a heeled ski boot to a ski, comprising: a pair of upstanding legs on the ski and adapted to laterally confine opposite sides of a boot heel, a transverse pin affixed to said boot, vertical slot means in said upstanding legs and extending downwardly from the top edge of said upstanding legs to receive respective ends of said transverse pin, said slot means being arranged to permit vertical separation of said boot heel from said ski and having sides which abut said transverse pin to prevent relative longitudinal movement between said ski boot and ski when said transverse pin is in said vertical slot means, the opposite end portions of said transverse pin being threaded and having threaded nuts thereon which tighten against said upstanding legs.

2. The system of claim 1 including detent means for holding said transverse pin in said vertical slot means and which requires a generally predetermined upward force in order to move said pin out of said slot means.

3. The system of claim 1 wherein said upstanding legs have spring detents for engagement with said nuts when said nuts are sufficiently close to said boot.

4. A system for releasably securing a ski boot to a plate for a ski, comprising: a plate having a transverse center portion and upstanding opposite legs adapted to laterally confine opposite sides of a boot, each upstanding leg having a vertical slot therein which opens outwardly of its upper end, and a ski boot having a transverse pin extending therethrough with opposite end portions arranged to be received in respective vertical slots when said boot is against said plate, and with said transverse pin being threaded to receive nuts for frictional adjustment against respective upstanding legs, said upstanding legs comprising folded over generally inverted U-shaped strips in which said slots are formed, said folded over portions forming spring detents that are confined between respective nuts and adjacent sides of said boot, and whereby said boot is restrained against lateral and longitudinal movement relative to said plate by said pin when the boot is against said plate.

5. The system of claim 4 wherein: said upstanding legs comprise folded over generally inverted U-shaped strips in which said slots are formed, said folded over portions forming spring detents that are confined between respective nuts and adjacent sides of said boot.

6. A system for releasably securing a heeled ski boot to a ski so as to provide three different degrees of attachment in three stages of elevation of the heel with respect to a ski, comprising: means for restraining the toe area of the boot with respect to a ski against lateral and forward movement, a pair of upstanding legs on the ski and adapted to laterally confine opposite sides of a boot heel when the heel is adjacent the ski and when in an intermediate elevation above the ski, transverse pin means affixed to either said upstanding legs or said heel and extending through said upstanding legs, said transverse pin means having a threaded portion thereon, a nut member threadably engaging the threaded portion of said transverse pin means, and detent means coacting with said nut and pin means for restraining vertical separation between said pin and the other one of said upstanding legs or said heel to which said pin means is not affixed only in the stage when the heel is adjacent the ski, said detent means being constructed and arranged so that relative rotation adjusts the detent action of said detent mechanism, and whereby the heel is restrained against lateral and vertical movement when adjacent the ski, is restrained against lateral separation only in the intermediate stage, and is free for lateral movement in the most elevated stage of heel separation.

7. A system for releasably securing a heeled ski boot to a ski so as to provide three different degrees of attachment in three stages of elevation of the heel with respect to a ski, comprising: means for restraining the toe area of the boot with respect to a ski against lateral and forward movement, a pair of upstanding legs on the ski and adapted to laterally confine opposite sides of a boot heel when the heel is adjacent the ski and when in an intermediate elevation above the ski, transverse pin means affixed to said upstanding legs and extending through said upstanding legs, said transverse pin means having threaded portions thereon, nut members threadedly engaging the threaded portions of said transverse pin means, and detent means coacting with said nut and pin means for restraining vertical separation between said pin and said heel only in the stage when the heel is adjacent the ski, said detent means being constructed and arranged to vary the force required for said vertical separation by relative rotation between said nut and pin means, and whereby the heel is restrained against lateral and vertical movement when adjacent the ski, is restrained against lateral separation only in the intermediate stage, and is free for lateral movement in the most elevated stage of heel separation.

8. A system for releasably securing a heeled ski boot to a ski, comprising: a pair of upstanding legs on the ski and adapted to laterally confine opposite sides of a boot heel, a pair of transverse pins affixed to respective upstanding legs and extending through said upstanding legs, said transverse pins having threaded portions thereon, nut members threadably engaging the threaded portions of said transverse pin means, and detent means coacting with said nuts and pins for restraining vertical separation between said pins and said heel, said detent means being constructed and arranged to vary the force required for said vertical separation with respect to both upstanding legs by relative rotation between said nuts and pins.

9. A system for releasably securing a heeled ski boot to a ski, comprising: a pair of upstanding legs on the ski and adapted to laterally confine opposite sides of a boot heel, a pair of threaded transverse pins respective ones of which threadably engage respective upstanding legs, said pins having ends projecting through said upstanding legs for engaging opposite sides of said heel, and indentations on opposite sides of said heel for receiving said projecting ends of said pins to restrain vertical separation of said heel from said ski, said upstanding legs or said projecting ends of said pins being yieldable to require progressively greater force for restraining vertical separation of said heel from said ski as said pins are progressively threaded through said upstanding legs.

10. The system of claim 9 wherein said pins are individually against opposite sides of said heel.

11. The system of claim 9 wherein said upstanding legs are springs which are progressively bowed outwardly as more and more of said pins project out of said upstanding legs against said heel.

12. The system of cliam 9 wherein said ends of said pins are hollow to receive a respective one of a pair of springs therein, and a pair of detent members respective ones of which are biased out of the hollow ends of respective pins by a respective spring for yieldably engaging a respective indentation in said heel.

* * * * *